US009383712B2

(12) United States Patent
Noguchi et al.

(10) Patent No.: US 9,383,712 B2
(45) Date of Patent: Jul. 5, 2016

(54) IMAGE FORMING APPARATUS

(71) Applicant: CANON KABUSHIKI KAISHA, Tokyo (JP)

(72) Inventors: Bunro Noguchi, Suntou-gun (JP); Yoshihiro Mitsui, Namazu (JP); Hisashi Taniguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/956,761

(22) Filed: Dec. 2, 2015

(65) Prior Publication Data

US 2016/0161899 A1 Jun. 9, 2016

(30) Foreign Application Priority Data

Dec. 4, 2014 (JP) ..... 2014-246082
Nov. 19, 2015 (JP) ..... 2015-226543

(51) Int. Cl.
*G03G 15/16* (2006.01)
*G03G 21/00* (2006.01)

(52) U.S. Cl.
CPC ..... *G03G 21/0011* (2013.01); *G03G 15/161* (2013.01)

(58) Field of Classification Search
USPC ..... 399/71, 98, 99, 101, 302, 308, 343, 399/344, 349, 350, 351, 353
See application file for complete search history.

(56) References Cited

U.S. PATENT DOCUMENTS 6,278,858 B1 * 8/2001 Nakazawa ..... G03G 15/161 399/302
2009/0232530 A1 9/2009 Saito et al.
2013/0142540 A1 * 6/2013 Kaneko ..... G03G 15/0189 399/101
2013/0195508 A1 * 8/2013 Shigezaki ..... G03G 15/0806 399/223

FOREIGN PATENT DOCUMENTS

JP 0950167 A 2/1997
JP 2009205012 A 9/2009

* cited by examiner

*Primary Examiner* — Hoan Tran
(74) *Attorney, Agent, or Firm* — Rossi, Kimms & McDowell LLP

(57) ABSTRACT

A developer bearing member, which bears developer to which additive particles have been added, and an image bearing member, on which an electrostatic latent image formed on the surface thereof is developed by rubbing contact with the developer bearing member, are configured so as to be separable; and during a first operation in which the image bearing member, while in a separated state from the developer bearing member, makes rubbing contact with a cleaning member, a second operation is carried out to place the developer bearing member temporarily in contact with the image bearing member and supply the additive particles to the contact portion between the cleaning member and the image bearing member.

16 Claims, 4 Drawing Sheets

IMAGE FORMING APPARATUS

BACKGROUND OF THE INVENTION

1. Field of the Invention

The present invention relates to an image forming apparatus which uses an electrophotographic system or an electrostatic recording system.

2. Description of the Related Art

Conventionally, an image forming apparatus based on an inline color system having a configuration wherein a plurality of image bearing members are arranged in the direction of rotation of an intermediate transfer member is known as an image forming apparatus, such as a laser beam printer. This image forming apparatus uniformly charges a photosensitive drum serving as an image bearing member by charging means, develops a toner image by developing means from an electrostatic latent image formed on the photosensitive drum by an exposure device, and transfers the toner image primarily to the intermediate transfer member. Thereupon, a full-color toner image is formed on the intermediate transfer member by repeating the same primary transfer step for each of a plurality of colors. Subsequently, the full-color toner image is secondarily transferred to a recording material, and the full-color toner image is fixed to the recording material by fixing means. Here, so-called single-component contact development is employed as the developing means. When forming an image, the electrostatic latent image on the photosensitive drum is developed by placing a developing roller which serves as a developer bearing member in contact with the photosensitive drum. Furthermore, when not forming an image, the developing roller is separated from the photosensitive drum.

The toner remaining on the intermediate transfer member (untransferred toner) which has not been transferred to the transfer material in the secondary transfer step must be removed from the intermediate transfer member. Japanese Patent Application Publication No. H9-50167 proposes a so-called simultaneous transfer and recovery system as a method for removing the untransferred toner from the intermediate transfer member. More specifically, the untransferred toner on the intermediate transfer member is reverse-transferred to the photosensitive drum in the next primary transfer step, due to the toner being charged with the opposite polarity to the normal charged state of the toner, by toner charging means. The toner which has been reverse-transferred to the photosensitive drum is eliminated by cleaning means, such as a cleaning blade. Moreover, Japanese Patent Application Publication No. 2009-205012 proposes a method using a conductive brush member and a conductive roller member as a method for recovering untransferred toner on the intermediate transfer member (called "secondary untransferred toner" below). More specifically, the secondary untransferred toner on the intermediate transfer member is mechanically scattered, primarily recovered and charged by applying a DC voltage to the brush member.

By adopting a configuration such as that in Japanese Patent Application Publication No. 2009-205012, recovery can be performed simultaneously with the primary transfer step for printing the next page, and it is possible to form images continuously without slowing the print speed. Furthermore, the secondary untransferred toner on the last page of a series of continuous prints is recovered by the cleaning blade of the photosensitive drum, when image formation is not being carried out. Subsequently, by alternately applying positive and negative voltages to the brush member, the primary recovered toner collected on the brush member is expelled onto the intermediate transfer member. Furthermore, when there is a large amount of the primary recovered toner in the brush member, for example, when there is a large number of continuous prints in a series, then printing is interrupted temporarily (image non-formation state) in order to maintain the toner charging performance of the brush member. The toner collected on the brush member is then expelled. Since the recovery of the secondary untransferred toner on the last page and/or the recovery of the expelled toner from the brush member is carried out when image formation is not being performed, then these steps are carried out with the photosensitive drum and the developing roller in a separated state.

SUMMARY OF THE INVENTION

However, when the configuration described below is adopted, vertical black stripes occur due to faulty cleaning of the photosensitive drum. To give a specific configuration, a cleaning blade of the intermediate transfer member is provided as a cleaning member for the intermediate transfer member after the secondary transfer step and between the toner charging brush members, in the configuration in Japanese Patent Application Publication No. 2009-205012. Furthermore, the drive sources for driving the intermediate transfer member and the photosensitive drum are a common drive source. In a configuration of this kind, when the toner is expelled onto the intermediate transfer member from the brush member and is then conveyed to the cleaning blade of the intermediate transfer member and recovered by driving the intermediate transfer member, the photosensitive drum is driven continuously for a long period of time. Since the intermediate transfer member and the photosensitive drum are controlled so as to be separated during this, then although the toner is not recovered onto the photosensitive drum from the intermediate transfer member, cleaning of the toner on the photosensitive drum is not possible and faulty cleaning occurs. When faulty cleaning of this kind occurs, the toner left by the cleaning blade appears directly as a vertical black stripe image, the charging roller becomes soiled by the toner, charging faults occur, and vertical streak images occur when the image is developed by the developing means.

This phenomenon occurs because, when the developing roller is separated from the photosensitive drum while image formation is not being performed, a so-called toner additive (particles which are added as supplementary particles to the toner particles, or external additive particles) which is transported from the developing roller to the photosensitive drum cease to be present. If the supply of toner additive to the edge portions of the cleaning blade ceases, then the toner additive layer which serves as a barrier that forms at the edge portions of the cleaning blade (called the "inhibiting layer" below) ceases to exist, and faulty cleaning becomes more liable to occur.

It is an object of the present invention to provide technology which enables a reduction in the occurrence of image defects caused by an insufficiency of additive particles in a contact portion between an image bearing member and a cleaning member.

In order to achieve the object described above, the image forming apparatus of the present invention comprises:

a developer bearing member which bears developer to which additive particles have been added;

an image bearing member which bears a developer image obtained by developing an electrostatic image, by contacting the developer bearing member;

a cleaning member which cleans a surface of the image bearing member by contacting the image bearing member; and an intermediate transfer member for bearing the developer image transferred from the image bearing member, wherein a first operation in which the image bearing member makes rubbing contact with the cleaning member is carried out in a state where the image bearing member is separated from both the intermediate transfer member and the developer bearing member;

a second operation in which the developer bearing member temporarily is placed to contact the image bearing member and in which the additive particles are supplied to a contact portion between the cleaning member and the image bearing member, can be carried out during the first operation.

Furthermore, in order to achieve the object described above, the image forming apparatus of the present invention comprises:

a developer bearing member which bears developer to which additive particles have been added;

an image bearing member on which an electrostatic latent image formed on a surface thereof is developed by rubbing contact with the developer bearing member;

a first cleaning member which cleans the surface of the image bearing member by rubbing contact with the image bearing member;

an intermediate transfer member to which a developer image developed on the surface of the image bearing member is transferred by rubbing contact with the image bearing member;

a brush member which charges residual toner on a surface of the intermediate transfer member by rubbing contact with the intermediate transfer member; and a second cleaning member which cleans the surface of the intermediate transfer member by rubbing contact with the intermediate transfer member, wherein the developer bearing member and the image bearing member, and the intermediate transfer member and the image bearing member, are configured so as to be respectively separable;

the image bearing member and the intermediate transfer member are driven simultaneously by a same drive source;

a cleaning operation to expel residual toner held by the brush member onto the surface of the intermediate transfer member and to remove the residual toner from the surface of the intermediate transfer member by the second cleaning member while not performing image formation, when development of the electrostatic latent image is not carried out, and in a state where the intermediate transfer member and the image bearing member are separated, can be carried out; and during the cleaning operation, there are provided:

a first time period in which the image bearing member and the developer bearing member are separated; and a second time period in which the image bearing member and the developer bearing member are placed in contact.

Furthermore, in order to achieve the object described above, the image forming apparatus of the present invention comprises:

a developer bearing member which bears developer to which additive particles have been added;

an image bearing member which bears a developer image obtained by developing an electrostatic image, by contacting the developer bearing member;

a cleaning member which cleans a surface of the image bearing member by contacting the image bearing member; and an intermediate transfer member forbearing the developer image transferred from the image bearing member, wherein a first operation in which the image bearing member makes rubbing contact with the cleaning member is carried out in a state where the image bearing member is separated from both the intermediate transfer member and the developer bearing member;

a second operation in which the developer bearing member temporarily is placed to contact the image bearing member and in which the developer is supplied to a contact portion between the cleaning member and the image bearing member, can be carried out during the first operation.

According to the present invention, it is possible to reduce the occurrence of image defects caused by an insufficiency of additive particles in the contact portion between the image bearing member and the cleaning member.

Further features of the present invention will become apparent from the following description of exemplary embodiments with reference to the attached drawings.

DESCRIPTION OF THE EMBODIMENTS

Embodiments of the present invention will now be described in detail based on examples with reference to the drawings. The dimensions, materials, shapes and relative dispositions or the like of the components described in the embodiments may need to be appropriately changed depending on the configuration and various conditions of the apparatus to which the present invention is applied. In other words, the scope of the invention is not limited to the following embodiments.

Embodiments

Embodiments of the present invention are characterized in that, when toner adhering to a toner charging brush 11 is expelled while image formation is not being performed, the occurrence of longitudinal black stripe images caused by faulty cleaning is prevented, by causing a developing roller 17K to contact a photosensitive drum 1K. In this case, the toner that has been expelled from the toner charging brush 11 is not recovered onto the photosensitive drum 1 because the intermediate transfer belt 5 and the photosensitive drum 1 are in a separated state. The toner expelled from the toner charging brush 11 is recovered upon reaching the cleaning blade 22 of the intermediate transfer belt, due to the driving of the intermediate transfer belt 5.

(1) Overview of Configuration and Operation of Image Forming Apparatus

Figure 1:
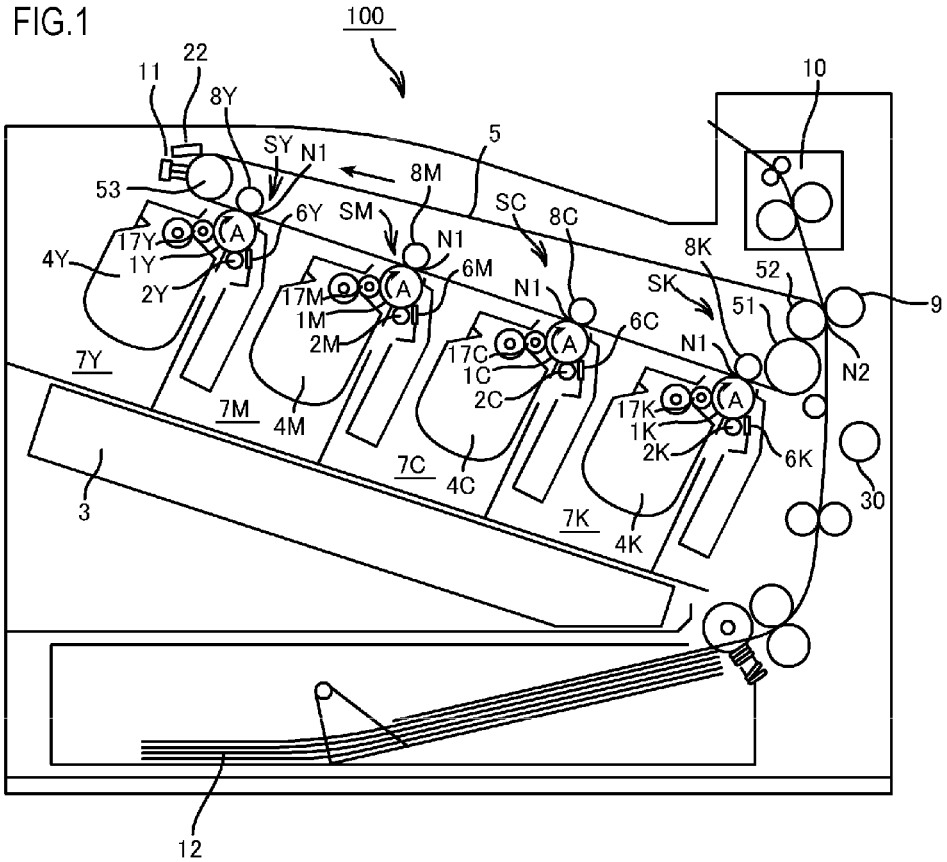
FIG. 1 is an illustrative drawing of an image forming apparatus relating to an embodiment of the invention.

The overall configuration of an electrophotographic image forming apparatus relating to an embodiment of the present invention (an image forming apparatus) is described below with reference to FIG. 1. FIG. 1 is a schematic cross-sectional diagram of an image forming apparatus 100 according to the present embodiment. The image forming apparatus 100 according to the present embodiment is a full-color laser printer which employs an in-line system and an intermediate transfer system. The image forming apparatus 100 can form a full-color image on a recording material (for example, recording paper), in accordance with image information. The image information is input to the main unit of the image forming apparatus from an image reading apparatus which is connected to the main unit of the image forming apparatus, or from a host device, such as a personal computer, which is connected in a communicable fashion with the main unit of the image forming apparatus.

The image forming apparatus 100 has a plurality of image forming units, namely, a first, second, third and fourth image forming unit SY, SM, SC, SK, which respectively form images of the respective colors of yellow (Y), magenta (M), cyan (C) and black (K). In the present embodiment, the first to fourth image forming units SY, SM, SC, SK are disposed in one line in a direction intersecting with the vertical direction. In the present embodiment, the configuration and operation of the first to fourth image forming units is substantially the same, except that the color of the image formed is different. Consequently, unless a particular distinction is required, the suffixes Y, M, C, K which are added to the reference numerals in order to indicate an element provided for one of the colors, are omitted, and a general description is provided.

In other words, in the present embodiment, the image forming apparatus 100 has four drum-type electrophotographic photosensitive members, in other words, photosensitive drums 1, which are arranged in a direction that intersects with the vertical direction, as a plurality of image bearing members. The photosensitive drum 1 is driven to rotate by drive means (a drive motor 30 forming a drive source) in the direction of arrow A (clockwise direction) in the drawings. Disposed about the periphery of the photosensitive drum 1 are: a charging roller 2 serving as charging means for uniformly charging the surface of the photosensitive drum 1, and a scanner unit (exposure device) 3 serving as exposure means for forming a electrostatic image (electrostatic latent image) on the photosensitive drum 1 by irradiating laser light on the basis of the image information. Furthermore, a developing unit (developing assembly) 4 serving as developing means for developing the latent image as a toner image, and a cleaning blade 6 serving as cleaning means for removing toner (untransferred toner) which is remaining on the surface of the photosensitive drum 1 after transfer are arranged about the periphery of the photosensitive drum 1. Moreover, an intermediate transfer belt 5 serving as an intermediate transfer member for transferring the toner image on the photosensitive drum 1 to the recording material 12 is disposed so as to oppose the four photosensitive drums 1.

In the present embodiment, the photosensitive drum 1, the charging roller 2 which serves as processing means that acts on the photosensitive drum 1, the developing unit 4 and the cleaning blade 6 are integrated to form a process cartridge 7. Each process cartridge 7 is attachable and detachable with respect to the apparatus main unit of the image forming apparatus 100. Here, the apparatus main unit means the constituent parts of the image forming apparatus 100 apart from the parts which are attachable and detachable as process cartridges 7. In the present embodiment, the process cartridges 7 of the respective colors all have the same shape, and the process cartridges 7 of each color accommodate toners of respective colors of yellow (Y), magenta (M), cyan (C) and black (K).

The intermediate transfer belt 5 forming the intermediate transfer member which is constituted by an endless belt contacts all of the photosensitive drums 1 and rotates in the direction of arrow B (anti-clockwise direction) in the drawings. The intermediate transfer belt 5 is wound about a plurality of supporting members, which are a driver roller 51, a secondary transfer opposing roller 52 and a driven roller 53. Four primary transfer rollers 8 are aligned as primary transfer means so as to oppose the respective photosensitive drums 1, on the inner circumferential surface side of the intermediate transfer belt 5, thereby forming a primary transfer nip N1 in the contact portion between each photosensitive drum 1 and the intermediate transfer belt 5. A bias of the opposite polarity to the normal charging polarity of the toner is applied to the primary transfer rollers 8 from a primary transfer bias power source, which is not illustrated. Consequently, the toner images on the photosensitive drums 1 are transferred onto the intermediate transfer belt 5 in the respective primary transfer nips N1. Moreover, a secondary transfer roller 9 serving as secondary transfer means is disposed at a position opposing the secondary transfer opposing roller 52 on the outer circumferential surface side of the intermediate transfer belt 5, thereby forming a secondary transfer nip N2 at the contact portion between the intermediate transfer belt 5 and the secondary transfer roller 9. A bias of the opposite polarity to the normal charging polarity of the toner is applied to the secondary transfer roller 9 from a secondary transfer bias power source, which is not illustrated. Consequently, the toner image on the intermediate transfer belt 5 is transferred to the recording material 12 in the secondary transfer nip N2.

When forming an image, firstly, the surface of the photosensitive drum 1 is charged uniformly by the charging roller 2. Thereupon, an electrostatic image (electrostatic latent image) corresponding to the image information is formed on the photosensitive drum 1, by laser light corresponding to the image information which is emitted from a scanner unit 3. Thereupon, the electrostatic image is developed as a toner image (developer image) by the developing unit 4, and is transferred (primary transfer) onto the intermediate transfer belt 5 by the action of the primary transfer roller 8.

For example, when forming a full-color image, the processes described above are carried out successively in the first to fourth image forming units SY, SM, SC, SK, and toner images of respective colors are successively superimposed on each other on the intermediate transfer belt 5. Thereupon, the toner images of the four colors on the intermediate transfer belt 5 are simultaneously transferred secondarily onto the recording material 12. Moreover, in a fixing apparatus 10, the toner image is fixed by applying heat and pressure to the recording material 12. Furthermore, the primary untransferred toner that remains on the photosensitive drum 1 after the primary transfer step is removed and recovered by the cleaning blade 6.

Furthermore, the secondary untransferred toner that remains on the intermediate transfer belt 5 after the secondary transfer step is firstly recovered by the intermediate transfer member cleaning blade 22. The toner that is not recovered completely here receives charge of the opposite polarity to the normal charging polarity of the toner, from the toner charging brush 11. The secondary untransferred toner to which a charge has been applied by the toner charging brush 11 is reverse-transferred to the photosensitive drum 1Y of the first image forming unit, during the primary transfer step of the next image formation operation, and is recovered by the cleaning blade 6.

(Process Cartridges)

Figure 2:
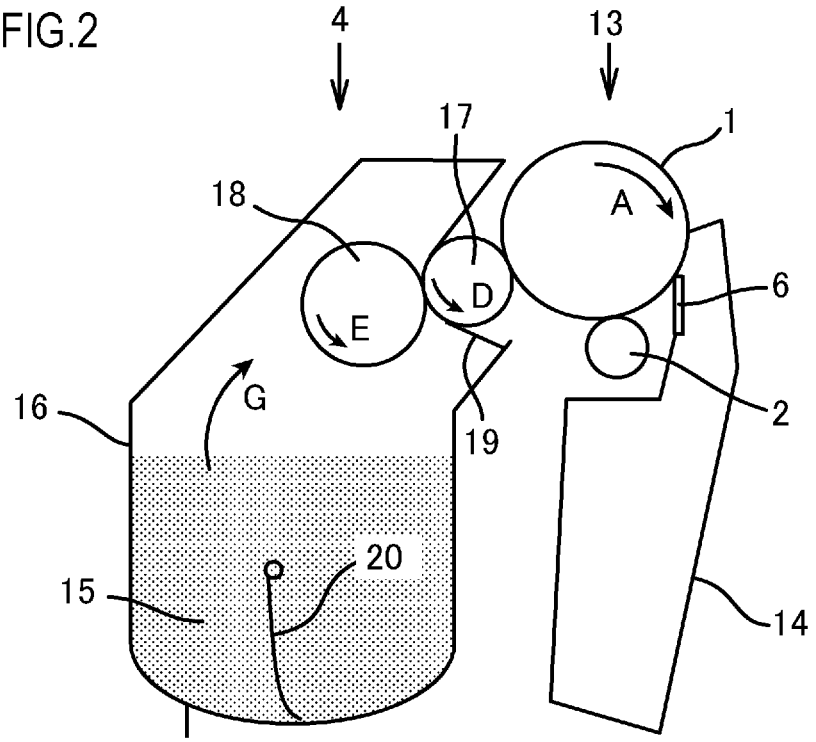
FIG. 2 is an illustrative drawing of a process cartridge according to an embodiment of the invention.

The overall configuration of the process cartridges 7 which are installed in the image forming apparatus 100 relating to the present embodiment will be described here with reference to FIG. 2. FIG. 2 is a schematic cross-sectional drawing of a process cartridge 7 according to the present embodiment as viewed in the lengthwise direction (rotational axis direction) of the photosensitive drum 1. In the present embodiment, apart from the type (color) of the developers which are accommodated, the configuration and operation of the process cartridges 7 of each color are the same. The process cartridges 7 each have a photosensitive member unit 13 (first unit) provided with a photosensitive drum 1, or the like, and a developing unit 4 (second unit) provided with a developing roller 17 (developer bearing member), or the like.

The photosensitive member unit 13 has a cleaning frame 14 as a frame which supports the various elements inside the photosensitive member unit 13. The photosensitive drum 1 is installed rotatably via bearings (not illustrated) on the cleaning frame 14. The photosensitive drum 1 is driven to rotate in the direction of arrow A in the drawings (the clockwise direction) in accordance with an image formation operation, due to the drive power of a drive motor 30 which serves as drive means (a drive source) being transmitted to the photosensitive member unit 13. The photosensitive drum. 1 which is the central element of the image formation process is an organic photosensitive member in which an undercoat layer, a carrier generating layer and a carrier transporting layer, which are functional films, are coated sequentially onto the outer circumferential surface of an aluminum cylinder. Furthermore, a cleaning member 6 and a charging roller 2 are disposed in the photosensitive member unit 13 so as to contact the circumferential surface of the photosensitive drum 1. The untransferred toner which has been removed from the surface of the photosensitive drum 1 by the cleaning member 6 falls down into the cleaning frame 14 and is accommodated therein.

The charging roller 2, which is charging means, rotates passively due to the roller portion thereof which is made of conductive rubber making pressurized contact with the photosensitive drum 1. In a charging step, a prescribed DC voltage is applied to the core of the charging roller 2 with respect to the photosensitive drum 1, whereby a uniform dark potential (Vd) is formed on the surface of the photosensitive drum 1. A spot pattern of laser light emitted in accordance with image data by the laser light from the scanner unit 3, as described above, is used to expose the photosensitive drum, and in the exposed segments, the surface charge is eliminated by the carrier from the carrier generating layer, and the potential falls. As a result of this, an electrostatic latent image in which the exposed segments have a prescribed light potential (Vl) and the unexposed segments have a prescribed dark potential (Vd) is formed on the photosensitive drum 1.

On the other hand, the developing unit 4 comprises a developing roller 17, a developing blade 19, a toner supply roller 18, toner 15 and a toner accommodating chamber 16 which accommodates toner. The toner 15 (developer) uses a non-magnetic spherical toner which is charged to a negative polarity as the normal polarity and which has a particle diameter of 7 μm. Furthermore, silica particles (additive particles) having a particle size of 20 nm are added as a toner additive on the surface of the toner 15.

The developing blade 19 contacts the developing roller by facing the developing roller and regulates the coated amount of toner which is supplied by the toner supply roller, while also applying a charge thereto. The developing blade 19 is a thin plate-shaped member, which creates a contact pressure by using the spring elasticity of the thin plate shape, and the surface thereof contacts the toner and the developing roller 17. The layer thickness of the toner is regulated at the same time as receiving a charge by triboelectric charging due to the rubbing of the developing blade 19 and the developing roller 17. Furthermore, in the present embodiment, a prescribed voltage is applied to the developing blade 19 from a blade bias power source (not illustrated), and stabilization of the toner coating is achieved.

The developing roller 17 and the photosensitive drum 1 rotate respectively in such a manner that the surfaces thereof move in the same direction with respect to the opposing portion (contact portion) (in the present embodiment, in the direction of arrows A and D which point in the upward directions). In the present embodiment, in the developing unit, the toner which has been charged negatively by triboelectric charging with respect to the prescribed DC bias applied to the developing roller 17 contacts (makes rubbing contact) with the photosensitive drum 1 and, due to the potential difference, is transferred only to the light potential portions, thereby turning the electrostatic latent image into a visible image.

The toner supply roller 18 is disposed so as to form a prescribed nip region on the circumferential surface of the developing roller 17, and rotates in the direction of arrow E in the drawings (the counter-clockwise direction). The toner supply roller 18 is an elastic sponge roller in which a foam body is formed on the outer circumference of a conductive metal core. The toner supply roller 18 and the developing roller 17 make contact with a prescribed penetration level. In the contact portion, the rollers rotate so as to move in mutually opposite directions, and due to this action, toner is supplied to the developing roller by the toner supply roller 18, while toner remaining on the developing roller as developing residue is scraped away.

A toner stirring member 20 is provided inside the toner accommodating chamber 16. The toner stirring member 20 stirs the toner accommodated inside the toner accommodating chamber 16, while also conveying the toner in the direction of arrow G in the drawings towards the upper part of the toner supply roller 18. In the present embodiment, the developing roller 17 and the toner supply roller 18 both have an external diameter of 20 mm, and the penetration level of the toner supply roller 18 into the developing roller 17 is set to 1.5 mm. In the present embodiment, a prescribed DC bias is applied to the developing roller 17, and in the developing region which the developing roller 17 contacts the photosensitive drum 1, the electrostatic latent image is made visible due to toner being transferred only to the light potential portions, as a result of the potential difference.

(Developing Roller Contact and Separation Mechanism)

Figure 3:
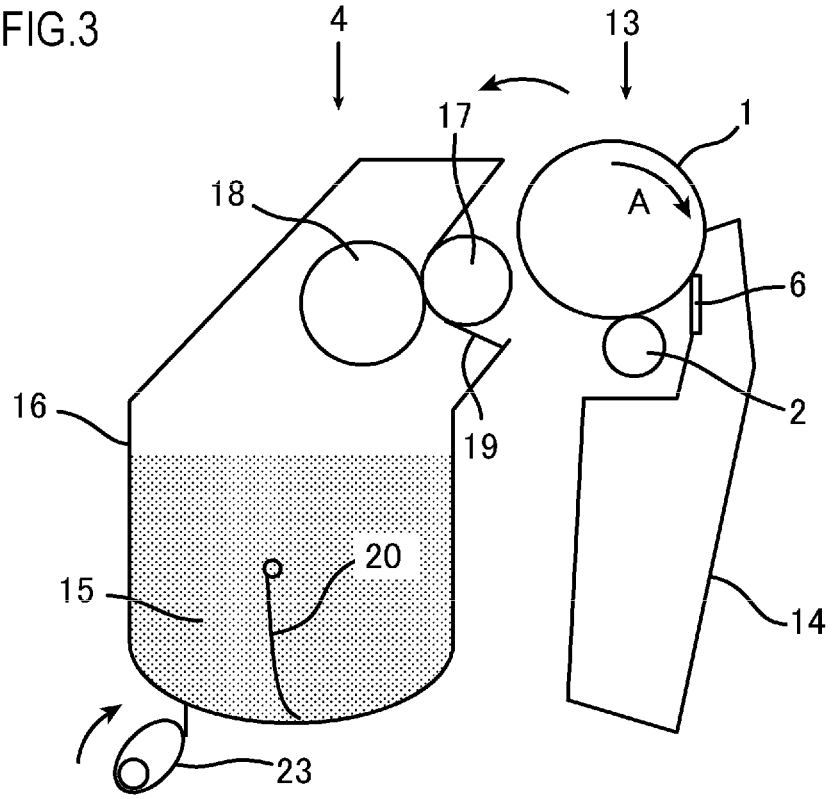
FIG. 3 is an illustrative drawing of a process cartridge according to an embodiment of the invention, during separation of a developing roller.

FIG. 3 is a schematic cross-sectional drawing of a process cartridge 7 according to the present embodiment, showing a state where the developing roller 17 is separated from the photosensitive drum 1. The developing roller 17 is configured so as to make contact with and separate from the photosensitive drum 1; during image formation, the developing roller 17 is placed in contact with the drum and when not performing image formation, the developing roller 17 is controlled so as to separate from the drum, as shown in FIG. 3, and the driving of the developing roller is halted. Here, "during image formation" means a period where a developer image is formed by transferring developer from the developing roller 17 in accordance with the electrostatic latent image formed on the photosensitive drum 1. Furthermore, "when not performing image formation" means a period where the developer image described above is not been formed. For example, this period means the time after image formation from the formation of a developer image on the photosensitive drum 1 until the photosensitive drum 1 has stopped (called "post-rotation" below), or before image formation from the start of the next print and the start of rotation of the photosensitive drum 1, to the start of formation of a developer image (called "pre-rotation" below). Furthermore, "when not performing image formation" also applies to times where a developer image is not formed in a specially provided time period, such as a time period corresponding to the time between sheets of recording material when a plurality of sheets of recording material 12 are conveyed during continuous printing, or an operation performed when adjusting the image density or an operation for expelling toner adhering to the toner charging brush, etc.

A specific example of a separating mechanism involves a cam 23 which is provided in the image forming apparatus 100 and of which the rotational position can be controlled, and a spring member (not illustrated) which is provided in the process cartridge 7 and which applies pressure such that the developing roller 17 and the photosensitive drum 1 make contact. The developing roller contact state is a state of contact in which the cam 23 is controlled to a position that does not apply pressure to the developing unit 4, and a pressing force is applied by the spring member of the process cartridge 7. Furthermore, the developing roller separated state is a state in which the developing unit 4 is pressed from the bottom and caused to rotate, by controlling the rotational position of the cam 23. The various operations of the constituent parts of the image forming apparatus 100 are controlled by means of the controller (CPU) provided in the apparatus main unit controlling the motive power source, such as a motor.

The separating mechanism for enabling separation of the developing roller 17 and the photosensitive drum 1 is not limited to one using a cam and a spring member as described above, and can also employ a cam only, provided that the mechanism enables control of separation.

(Intermediate Transfer Belt)

A 100 μm-thick film of polyvinylidene fluoride adjusted to a volume resistivity of $10^{11}$ Ωcm is used for the intermediate transfer belt 5. Furthermore, the intermediate transfer belt 5 is wrapped about three axes: the driver roller 51, the secondary transfer opposing roller 52, and the driven roller 53.

(Primary Transfer Rollers)

An elastic roller having a volume resistivity of $10^5$ to $10^9$ Ωcm and a rubber hardness of 30° (Asker C hardness meter) is used for the primary transfer rollers 8. Each primary transfer roller 8 is pressed with a total pressure of approximately 9.8 N against the photosensitive drum 1 via the intermediate transfer belt 5. Furthermore, the primary transfer roller 8 rotates passively in accordance with the rotation of the intermediate transfer belt 5. Moreover, it is possible to apply a voltage of −2.0 to 3.5 kV to the primary transfer roller 8, from a primary transfer power source (not illustrated).

(Toner Charging Brush)

A brush member configured with dense nylon fibers having a conductivity of $10^6$ to $10^9$ Ωcm is used as a toner charging brush 11 and is fixed in position. In the present embodiment, the front tip position of the toner charging brush 11 is set to achieve a penetration level of 1.0 mm with respect to the surface of the intermediate transfer belt 5. In this way, the toner charging brush 11 positioned to the upstream side in the direction of movement of the surface of the intermediate transfer belt 5 rubs the surface of the intermediate transfer belt 5 in accordance with the movement of the intermediate transfer belt 5. The toner charging brush 11 is disposed to the downstream side of the secondary transfer section and to the upstream side of the first image forming section, in the direction of movement of the intermediate transfer belt 5. It is possible to apply a voltage of −2.0 to +2.0 kV to the toner charging brush 11 from the high-voltage power source (not illustrated) which serves as toner charging brush voltage supply means.

(2) Description of Operation when Recovering Secondary Untransferred Toner (Secondary Untransferred Toner Recovery Method)

The secondary untransferred toner recovery method (fourth operation) which is a cleaning operation carried out during printing is now described in detail. The secondary untransferred toner left on the intermediate transfer belt 5 after the secondary transfer step is firstly recovered by the intermediate transfer member cleaning blade 22 (second cleaning member). With respect to the toner that is not recovered completely in this case, a bias of opposite polarity to the normal charging polarity of the toner, more specifically, in the present embodiment, a +1.5 kV bias of positive polarity, is applied to the toner charging brush 11. Consequently, the toner which is not recovered completely by the intermediate transfer member cleaning blade is charged to a positive polarity upon passing the toner charging brush 11. Furthermore, in this case, the negative toner which has not been charged completely to a positive polarity is held partially on the toner charging brush 11. The toner to which a positive charge has been applied by the toner charging brush 11 is reverse-transferred to the photosensitive drum 1Y of the first image forming unit during the primary transfer step and is recovered by the cleaning blade 6 (first cleaning member).

Here, one reason why the secondary untransferred toner passes the intermediate transfer belt cleaning blade 22 may be because the surface properties of the intermediate transfer belt (the surface unevenness and/or frictional coefficient) is not stable compared to the surface of the photosensitive drum. When there is an unevenness in a portion of the surface of the intermediate transfer belt, chipping occurs at the edges of the intermediate transfer belt cleaning blade 22 and faulty cleaning is liable to occur. Furthermore, when the coefficient of friction of the surface of the intermediate transfer belt is not stable, then the wrapping mode of the edge portion of the cleaning blade is not stable and the pressing force on the intermediate transfer belt 5 also varies, which means that faulty cleaning is liable to occur. In particular, in a low-temperature environment where the rubber elastic modulus of the cleaning blade is lowered, faulty cleaning may occur on the intermediate transfer belt.

(Toner Charging Brush Expulsion Step)

The cleaning operation which is a step for expelling toner from the toner charging brush 11 (third operation) is now described in detail. As stated above, the toner of negative polarity which has not been completely charged to a positive polarity by the toner charging brush 11 is held temporarily in the toner charging brush 11. Therefore, when image formation is carried out repeatedly, the toner collects on the toner charging brush 11, the electrical resistance increases, and the charging performance of the toner charging brush 11 declines. Therefore, it is necessary to provide a step for expelling the toner held in the toner charging brush 11, onto the intermediate transfer belt 5. In the present embodiment, a bias of the same polarity as the normal charging polarity of the toner, more specifically, in the present embodiment, a negative bias of −1.5 kV, is applied to the toner charging brush 11 in a post-rotation step when not performing image formation, and the toner of negative polarity is thereby expelled onto the intermediate transfer belt 5. The intermediate transfer belt 5 and the photosensitive drum 1 are configured so as be separable, and in this case, the intermediate transfer belt 5 and the photosensitive drum 1 are in a separated state and the expelled toner is not recovered onto the photosensitive drum 1. Instead of this, the toner expelled from the toner charging brush 11 is recovered upon reaching the cleaning blade 22 of the intermediate transfer belt, due to the driving of the intermediate transfer belt 5.

Furthermore, in the present embodiment, a configuration is adopted in which the motor for driving the intermediate transfer belt 5 and the photosensitive drum 1K of the fourth image forming unit is a common motor (drive motor 30), and when the intermediate transfer belt 5 is driven, the photosensitive drum 1K of the fourth image forming unit is always driven simultaneously as well. In the present embodiment, during the expulsion step, the photosensitive drum 1 and the secondary transfer roller 9 are separated from the intermediate transfer belt 5 and the photosensitive drums 1Y, 1M, 1C are controlled so as to stop. However, the photosensitive drum. 1K is driven due to sharing the drive motor with the intermediate transfer belt 5, as described above. Consequently, the photosensitive drum 1K is driven continuously for approximately one revolution of the intermediate transfer belt 5, when recovering the expelled toner. In the present embodiment, an expulsion step is carried out during post-rotation, but it is also possible to provide a time period during which an expulsion step is carried out, separately from printing. Moreover, in the present embodiment, this step is carried out periodically each time 100 sheets are printed.

(3) Explanation of Characteristics of Present Embodiment

In the present embodiment, during the expulsion step from the toner charging brush 11 which is carried out when not performing image formation as described above, a second operation for causing the developing roller 17 to contact the photosensitive drum 1 temporarily can be carried out during the execution of the first operation for separating the developing roller 17 from the photosensitive drum 1 (in this case, the photosensitive drum 1 is also separated from the intermediate transfer belt 5). A comparison was made of the cleaning performance achieved in actual practice while carrying out the expulsion step.

In the present embodiment, an operation of separating the photosensitive drum 1 from the intermediate transfer belt 5 and/or the developing roller 17 during the expulsion step from the toner charging brush 11 is given as an example of the first operation, but the first operation is not limited to this. In other words, an operation in which there is no step of expulsion from the toner charging brush 11, and the photosensitive drum 1 is driven in a state where the photosensitive drum 1 is separated from both the intermediate transfer belt 5 and the developing roller 17, can be set as the first operation. The present invention relates to the state of the contact portion where the cleaning plate contacts the photosensitive drum. During the various operations, there are states where the photosensitive drum is separated from the developing roller and/or intermediate transfer belt and no material is supplied to the contact portion. Therefore, in the present invention, additive particles are supplied to the contact portion by temporarily placing the developing roller in contact with the drum.

Furthermore, an operation where the developing roller is temporarily placed in contact with the photosensitive drum is taken as the second operation, but more specifically, it is desirable for this contact to take place prior to the image formation operation. More desirably, the photosensitive drum and the developing roller are placed in contact with each other during the post-rotation after the image formation period and when a prescribed time has elapsed after starting post-rotation. Here, the state where the photosensitive drum and the developing roller are placed in contact during post-rotation means a state of contact which is created by placing the drum and roller in contact again after first changing from the state of contact during image formation to a state of separation, rather than a state of contact created by maintaining the state of contact between the developing roller and the photosensitive drum during image formation and continuing this state unaltered during post-rotation as well. In the present embodiment, a configuration is adopted in which the photosensitive drum and the developing roller are in contact immediately after the start of post-rotation, but are temporarily separated and then placed in contact again in the second operation. The invention is of course not limited to this, and the photosensitive drum and the developing roller may be separated at the start of post-rotation.

Figure 4:
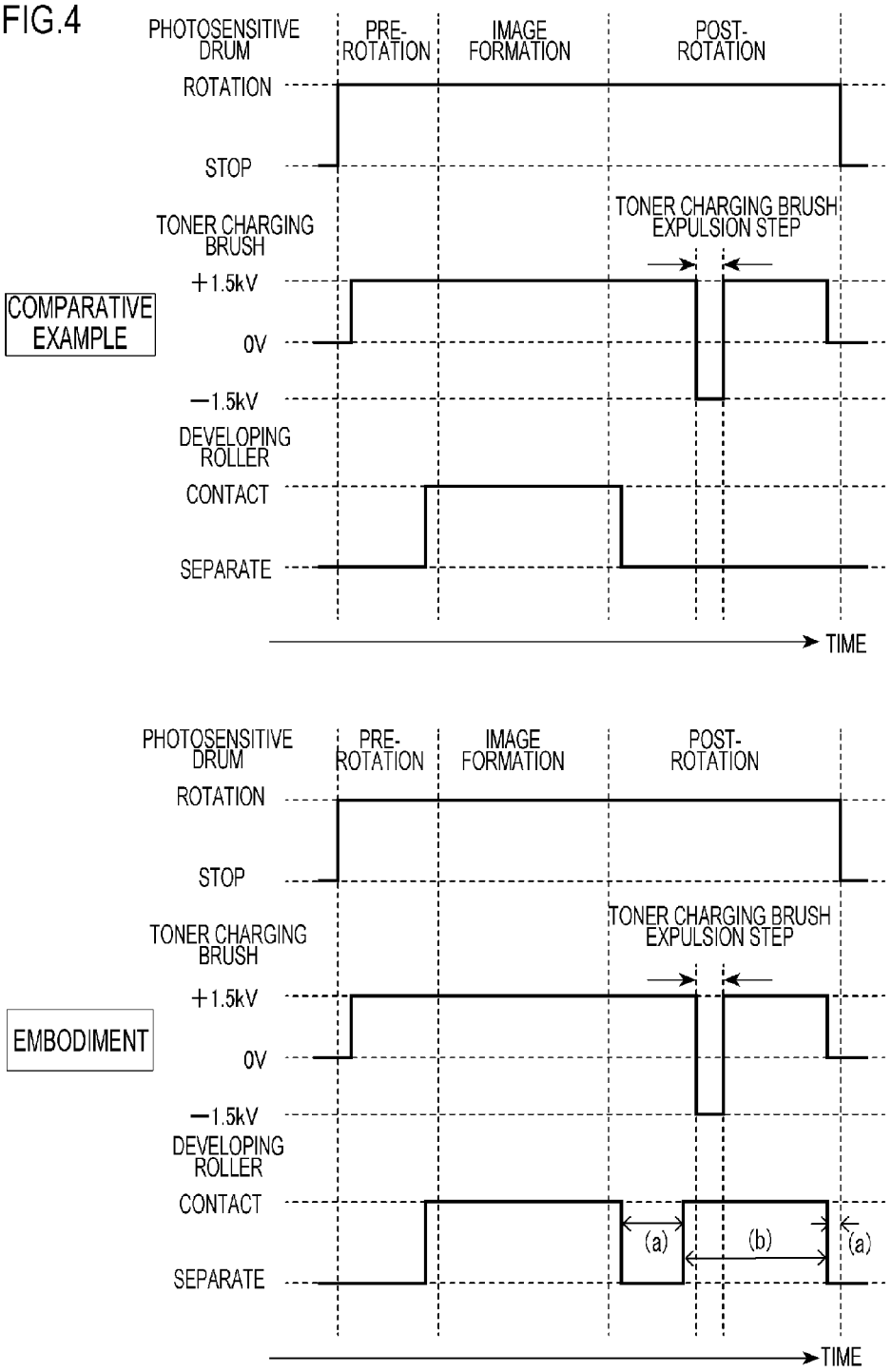
FIG. 4 is an illustrative diagram of developing roller contact and separation timings in an embodiment and a comparative example.

FIG. 4 shows a timing chart of the timings of rotation and stopping of the photosensitive drum 1K, the timings of application of a positive or negative bias to the toner charging brush 11, and the timings of contact and separation of the developing roller 17K, in the comparative example and the embodiment. As shown in FIG. 4, the timing of rotation and stopping of the photosensitive drum 1K and the timing of changing the bias applied to the toner charging brush 11, from +1.5 kV to −1.5 kV, during the expulsion step from the toner charging brush 11 during post-rotation, are the same in the comparative example and the embodiment. However, the state of separation of the developing roller 17K and the photosensitive drum 1K during the expulsion step from the toner charging brush 11 is different. In the comparative example, the developing roller 17K and the photosensitive drum 1K are separated immediately after the end of image formation, and printing ends directly in this state. In the embodiment, meanwhile, the developing roller 17K is temporarily separated immediately after ending image formation (first time period a), and the developing roller 17K is placed in contact with the photosensitive drum 1K immediately before the expulsion step from the toner charging brush 11 (second time period b). The developing roller 17K is controlled so as to separate immediately before the photosensitive drum 1K stops (first time period a).

Common conditions were set in that the expulsion step from the toner charging brush 11 was carried out after continuous printing of 100 sheets of horizontal line images having a printing density of 5% of each color, a yellow half-tone image was printed at a print rate of 25% immediately thereafter, and the occurrence of image defects (vertical black stripes) was confirmed. The image forming apparatus 100 was installed in a low-temperature low-humidity environment (15° C.; 10% RH) which is severe in terms of faulty cleaning.

Table 1 Faulty Cleaning Results in Expulsion and Recovery Step

TABLE 1

| Faulty cleaning results in expulsion and recovery step | | |
|---|---|---|
| | State of contact between developing roller and photosensitive drum | Occurrence of vertical black stripes due to faulty cleaning? |
| Comparative Example | Separated | Yes |
| Embodiment | In Contact | No |

Although vertical black stripes occurred due to faulty cleaning in the comparative example, as shown in Table 1, no faulty cleaning occurred in the configuration according to the embodiment. The faulty cleaning in the comparative example occurred because the toner left at the edges of the cleaning blade was not scraped away by the cleaning blade. In the present embodiment, the motor of the intermediate transfer belt 5 and the motor driving the photosensitive drum 1K of the fourth image forming unit are a common motor, and therefore the photosensitive drum 1K is also driven during the expulsion step until the expelled toner is recovered by intermediate transfer belt cleaning blade. In this way, when there is no supply of additive to the edge portions of the cleaning blade for a long period of time, the inhibiting layer ceases to exist and faulty cleaning is liable to occur. Furthermore, if toner charged to a positive polarity is present at the edges of the cleaning blade, then the toner penetrates into the inhibiting layer with a high electrostatic attachment force with respect to the surface of the photosensitive drum 1, which has a negative polarity, and therefore the inhibiting layer is liable to collapse.

In this case, by placing the developing roller 17 in contact with the photosensitive drum 1, the additive transfers directly to the photosensitive drum 1 from the covering toner that has transferred to the photosensitive drum 1 and from the toner that has been coated onto the developing roller 17, and is supplied to the edge portions of the cleaning blade 6. Furthermore, the additive also transfers to the photosensitive drum 1 from the covering toner that has shifted to the photosensitive drum 1 from the developing roller 17, and is supplied to the edge portions of the cleaning blade 6. The supplied additive forms an inhibiting layer that serves as a barrier layer at the edge portions of the cleaning blade and thus improves the cleaning performance.

Figure 5:
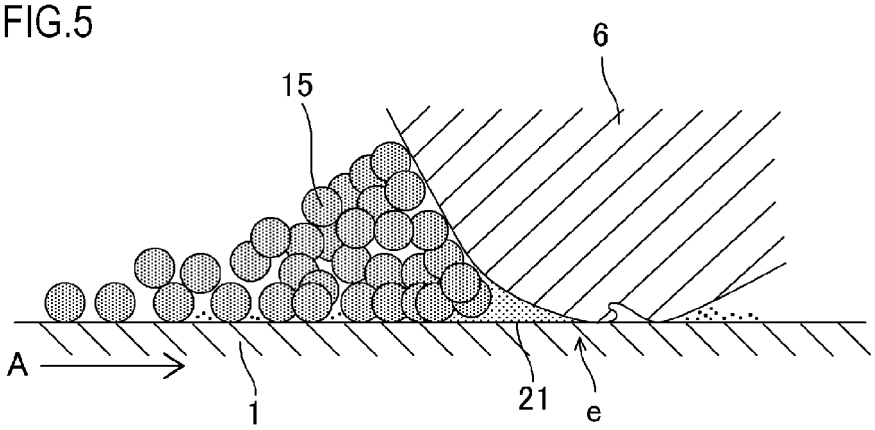
FIG. 5 is an enlarged diagram of edge portions of a cleaning blade according to an embodiment of the invention.

The mechanism by which the cleaning performance is improved is described by using the enlarged diagram of the edge portions of the cleaning blade shown in FIG. 5. The cleaning blade 6 is a blade member which extends in a direction counter to the direction of rotation of the photosensitive drum 1. As shown in FIG. 5, the cleaning blade 6 contacts the photosensitive drum 1 in a direction counter to the direction of rotation of the photosensitive drum 1, in other words, the edge portion e which is the tip portion of the blade extending in the opposite direction to the direction of movement of the photosensitive drum 1 with respect to the cleaning blade 6 contacts the surface of the photosensitive drum 1. Therefore, the edge portion e of the cleaning blade 6 becomes wrapped in the direction of movement of the photosensitive drum 1 in accordance with the rotation of the photosensitive drum 1. Toner additive that has transferred to the photosensitive drum 1 as described above collects in the wedge portion (contact portion) which is wrapped in in this way, and forms a layer (called the "inhibiting layer 21" below). If it is sought to clean the toner in a state where there is no inhibiting layer 21, which is formed by a layer of additive particles, then the toner readily sinks in via the wedge portion which is wrapped in at the edges of the blade and faulty cleaning is liable to occur. When an inhibiting layer 21 is present in the edge portions of the cleaning blade, as in FIG. 5, then this sinking in of the toner ceases to occur and the cleaning performance improves. On the other hand, the inhibiting layer 21 is formed by the toner additive which has a size of approximately 20 nm, and therefore a fixed amount of additive escapes from the edge portions of the cleaning blade at all times. Therefore, when the developing roller 17 separates from the photosensitive drum 1 and the supply of additive to the edge portions of the cleaning blade stops, then the inhibiting layer 21 gradually disappears, thus leading to a decline in the cleaning performance. The longer the contact time of the developing roller 17K on the photosensitive drum 1K, the greater the effect in forming an inhibiting layer, and therefore the more readily that beneficial effects are obtained. (In other words, the second operation for placing the developing roller and the photosensitive drum in contact is an operation for forming a layer of additive particles (an inhibiting layer).) In the present embodiment, for preventing the disappearance of the inhibiting layer due to the rotation of the photosensitive drum 1K over a long period of time, the developing roller 17K is controlled so as to make contact immediately before the photosensitive drum 1K stops after the start of the expulsion step.

As described above, when the configuration of the present embodiment is used, it is possible to prevent the occurrence of vertical black stripe images due to faulty cleaning, even in cases where the inhibiting layer is insufficient on the cleaning blade of the photosensitive drum and the cleaning performance declines, when image formation is not being performed. Furthermore, since the drive source of the intermediate transfer belt 5 and the photosensitive drum 1K is a common drive source (the photosensitive drum 1K and the intermediate transfer belt 5 are driven simultaneously by a drive motor 30 which is the same drive source), then it is possible to suppress the cost of the image forming apparatus.

In the present embodiment, only the developing roller 17K is made to contact the photosensitive drum 1K during the expulsion step, but the timing of this contact and/or the image forming unit involved are not limited to this. In other words, the developing roller 17 and the photosensitive drum 1 may be placed in contact at a timing other than during the expulsion step, when there is a possibility of the photosensitive drum 1 being driven for a long time and of the occurrence of faulty cleaning, such as during a toner density adjustment step and/or a color deviation correction step, or the like. Furthermore, with regards to the image forming unit also, the contacting operation is not limited to being carried out only in the photosensitive drum which has a drive source that is common with the intermediate transfer belt 5, and since there is a possibility of faulty cleaning occurring in the image forming units where toner is recovered from the intermediate transfer belt 5, as described above, then the contacting operation may also be carried out when image formation is not being performed.

Furthermore, in an image forming apparatus in which the intermediate transfer belt cleaning blade 22 is removed from the configuration of the present embodiment, it is possible to carry out an operation to place the developing roller 17 in contact with the photosensitive drum 1 when not performing image formation, which is a characteristic feature of the present embodiment. In other words, the present embodiment can be applied also to an image forming apparatus in which the toner remaining on the intermediate transfer belt 5 is charged by the toner charging brush 11 and is transferred to the photosensitive drum 1. More specifically, when the photosensitive drum 1 rotates for a long time when not performing image formation, and the inhibiting layer is insufficient, then by causing the developing roller 17 to make contact with the photosensitive drum 1, it is possible to prevent the occurrence of vertical black stripe images due to faulty cleaning.

Furthermore, a temperature sensor (temperature detection portion) for detecting the ambient temperature of the image forming apparatus may be provided in the apparatus main unit and control for causing the developing roller 17 to come into contact with the photosensitive drum 1 as in the present embodiment may be carried out only when the image forming apparatus 100 has detected a prescribed temperature or lower. Faulty cleaning is more liable to occur in a low-temperature environment where the rubber elastic modulus of the cleaning blade declines and the blade does not follow the photosensitive drum so readily. Therefore, by implementing the control of the present embodiment only when a temperature of 20° C. or below is detected, it is possible to prevent excessive degradation of the toner and/or the members such as the developing roller 17, due to the rotation of the developing roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-246082, filed on Dec. 4, 2014, and No. 2015-226543, filed on Nov. 19, 2015, which are hereby incorporated by reference herein in their entirety.

What is claimed is:

1. An image forming apparatus, comprising:

a developer bearing member which bears developer to which additive particles have been added;

an image bearing member which bears a developer image obtained by developing an electrostatic image, by contacting the developer bearing member;

a cleaning member which cleans a surface of the image bearing member by contacting the image bearing member; and an intermediate transfer member for bearing the developer image transferred from the image bearing member, wherein a first operation in which the image bearing member makes rubbing contact with the cleaning member is carried out in a state where the image bearing member is separated from both the intermediate transfer member and the developer bearing member;

a second operation in which the developer bearing member temporarily is placed to contact the image bearing member and in which the additive particles are supplied to a contact portion between the cleaning member and the image bearing member, can be carried out during the first operation.

2. The image forming apparatus according to claim 1, wherein the second operation is an operation for forming a layer of additive particles in the contact portion.

3. The image forming apparatus according to claim 1, wherein the cleaning member is a blade member of which a tip section extending in an opposite direction to a direction of movement of the image bearing member with respect to the cleaning member contacts the surface of the image bearing member.

4. The image forming apparatus according to claim 1, wherein the first operation is carried out while not performing image formation, when development of the electrostatic image is not carried out.

5. The image forming apparatus according to claim 1, wherein the intermediate transfer member and the image bearing member are configured so as to be separable; and the intermediate transfer member and the image bearing member are separated during the first operation.

6. The image forming apparatus according to claim 5, further comprising a brush member which makes rubbing contact with the intermediate transfer member.

7. The image forming apparatus according to claim 6, further comprising a second cleaning member which makes rubbing contact with the intermediate transfer member, wherein a third operation to expel residual toner held by the brush member onto a surface of the intermediate transfer member and to remove the residual toner from the surface of the intermediate transfer member by the second cleaning member in a state where the intermediate transfer member and the image bearing member are separated, can be carried out; and the first operation is carried out during the third operation.

8. The image forming apparatus according to claim 5, wherein a fourth operation to transfer residual toner on a surface of the intermediate transfer member onto the image bearing member and to remove the residual toner from the surface of the image bearing member by the cleaning member in a state where the developer bearing member and the image bearing member are separated, can be carried out.

9. The image forming apparatus according to claim 5, wherein the image bearing member and the intermediate transfer member are driven simultaneously by a same drive source.

10. The image forming apparatus according to claim 1, further comprising a temperature detection portion, wherein the second operation is carried out when a temperature detected by the temperature detection portion is equal to or less than a prescribed temperature.

11. The image forming apparatus according to claim 1, wherein at least the developer bearing member, the image bearing member and the cleaning member are integrated as a cartridge, and are configured so as to be attachable and detachable with respect to a main unit of the image forming apparatus.

12. The image forming apparatus according to claim 11, wherein the cartridge includes:

a first unit including the image bearing member and the cleaning member; and a second unit including the developer bearing member, and the first unit and the second unit are configured so as to be separable in such a manner that the image bearing member and the developer bearing member are separated.

13. An image forming apparatus, comprising:

a developer bearing member which bears developer to which additive particles have been added;

an image bearing member on which an electrostatic latent image formed on a surface thereof is developed by rubbing contact with the developer bearing member;

a first cleaning member which cleans the surface of the image bearing member by rubbing contact with the image bearing member;

an intermediate transfer member to which a developer image developed on the surface of the image bearing member is transferred by rubbing contact with the image bearing member;

a brush member which charges residual toner on a surface of the intermediate transfer member by rubbing contact with the intermediate transfer member; and a second cleaning member which cleans the surface of the intermediate transfer member by rubbing contact with the intermediate transfer member, wherein the developer bearing member and the image bearing member, and the intermediate transfer member and the image bearing member, are configured so as to be respectively separable;

the image bearing member and the intermediate transfer member are driven simultaneously by a same drive source;

a cleaning operation to expel residual toner held by the brush member onto the surface of the intermediate transfer member and to remove the residual toner from the surface of the intermediate transfer member by the second cleaning member while not performing image formation, when development of the electrostatic latent image is not carried out, and in a state where the intermediate transfer member and the image bearing member are separated, can be carried out; and during the cleaning operation, there are provided:

a first time period in which the image bearing member and the developer bearing member are separated; and a second time period in which the image bearing member and the developer bearing member are placed in contact.

14. The image forming apparatus according to claim 13, wherein at least the developer bearing member, the image bearing member and the cleaning member are integrated as a cartridge, and are configured so as to be attachable and detachable with respect to a main unit of the image forming apparatus.

15. The image forming apparatus according to claim 14, wherein the cartridge includes:

a first unit including the image bearing member and the cleaning member; and a second unit including the developer bearing member; and the first unit and the second unit are configured so as to be separable in such a manner that the image bearing member and the developer bearing member are separated.

16. An image forming apparatus, comprising:

a developer bearing member which bears developer to which additive particles have been added;

an image bearing member which bears a developer image obtained by developing an electrostatic image, by contacting the developer bearing member;

a cleaning member which cleans a surface of the image bearing member by contacting the image bearing member; and an intermediate transfer member for bearing the developer image transferred from the image bearing member, wherein a first operation in which the image bearing member makes rubbing contact with the cleaning member is carried out in a state where the image bearing member is separated from both the intermediate transfer member and the developer bearing member;

a second operation in which the developer bearing member temporarily is placed to contact the image bearing member and in which the developer is supplied to a contact portion between the cleaning member and the image bearing member, can be carried out during the first operation.

* * * * *